United States Patent [19]

Jansson et al.

[11] Patent Number: 4,955,969

[45] Date of Patent: Sep. 11, 1990

[54] FREE TECHNIQUE SKI POLE

[75] Inventors: Rainer Jansson, Salem, Mass.; Aimo Pirttiaho, Helsinki, Finland

[73] Assignee: Exel Oy, Helsinki, Finland

[21] Appl. No.: 345,564

[22] Filed: May 1, 1989

Related U.S. Application Data

[63] Continuation of Ser. No. 120,951, Nov. 16, 1987, abandoned.

[30] Foreign Application Priority Data

Nov. 18, 1986 [FI] Finland ..... 874681

[51] Int. Cl.[5] ..... A63C 11/24

[52] U.S. Cl. ..... 280/824

[58] Field of Search ..... 280/824, 819

[56] References Cited

U.S. PATENT DOCUMENTS

| | | | |
|---|---|---|---|
| 3,963,254 | 6/1976 | Aho | 280/824 |
| 4,129,312 | 12/1978 | Loffezholz | 280/824 |
| 4,336,949 | 6/1982 | Aito | 280/824 |
| 4,676,525 | 6/1987 | Sorlein et al. | 280/824 |
| 4,787,652 | 11/1988 | Pronzati | 280/824 |

FOREIGN PATENT DOCUMENTS

| | | | |
|---|---|---|---|
| 2514652 | 4/1983 | France | 280/824 |
| 82376 | 9/1953 | Norway | 280/824 |
| 598841 | 5/1978 | Switzerland | 280/824 |
| 0745530 | 7/1980 | U.S.S.R. | 280/824 |

OTHER PUBLICATIONS

Reex Certificate B1 3963254, Aito, Jun. 7, 1988.

*Primary Examiner*—David M. Mitchell

*Attorney, Agent, or Firm*—Price, Heneveld, Cooper, DeWitt & Litton

[57] ABSTRACT

The object of the invention is a free technique ski pole comprising a pole stick (2), to the lower end of which is rigidly fixed by sleeve-like fitting (5) a plastic snow disc (3), near the front edge (8, 9) of which is a spike-fastening sleeve (6) to which the spike (7) is fastened. In free technique skiing the pole is in a sideways inclined position during pushing. The spike's hold is thus improved and the support of the snow disc's bearing surface on the ground becomes more even, when looking from the front, the direction of the longitudinal axis of the pole stick forms an angle of about 5°–15° with respect to the direction of the spike (7). Correspondingly, the snow disc edge (10) on the side of the skier is positioned higher and the bearing surface (12) connected to it forms a smaller angle with respect to the horizontal plane than the outer side edge (11) of the snow disc and the bearing surface (13) connected to it.

11 Claims, 2 Drawing Sheets

FREE TECHNIQUE SKI POLE

This is a continuation of co-pending application Ser. No. 120,951 filed on Nov. 16, 1987, and now abandoned.

The object of the present invention is a free technique (skating) ski pole comprising a pole stick to the lower end of which is rigidly fixed by sleeve-like fitting a plastic snow disc, near the front edge of which is a spike-fastening sleeve to which the spike is fastened.

A ski pole of this kind for the classic technique (in skiing) is known from the applicant's FI-patent publication no. 52816. This ski pole has proved to be superior due to the fact that the front edge of the snow disc is situated near the sleeve-like part of the snow disc which means that the gripping to the ground of even a short spike member is always guaranteed and that the forces resisting the forward movement of the pole are minimized. In pushing the pole downwards, a torque turning the pole forwards is created when the pole is supported on the ground on the snow disc bearing surface which is situated behind the turning axis of the pole.

The aim of the present invention is to develop this ski pole type further to make it even more suitable for use as a free technique ski pole as well.

Figure 1:
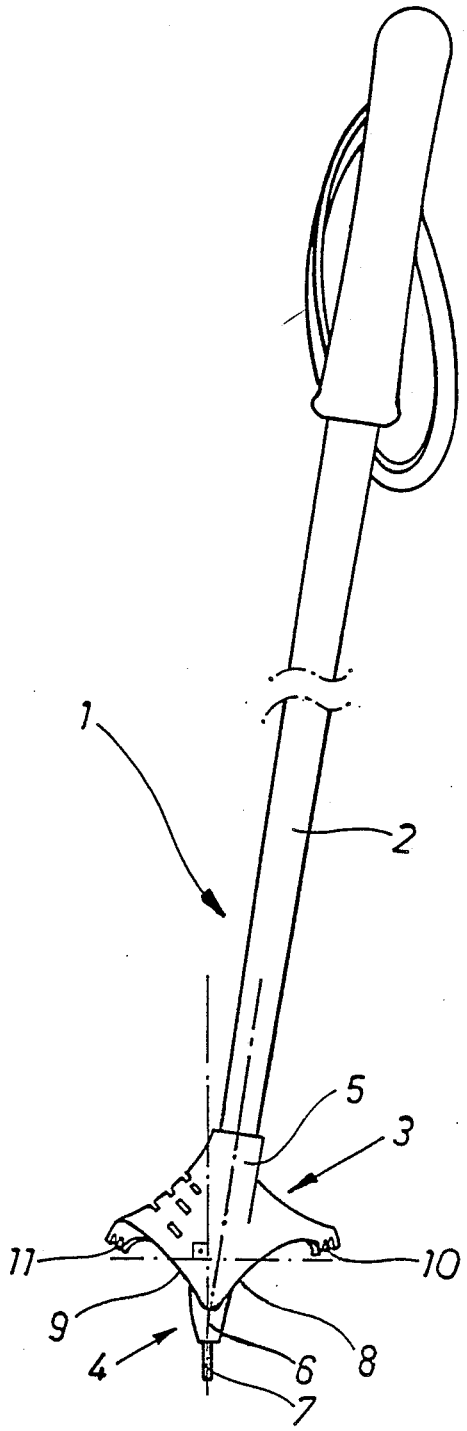
Figure 3:
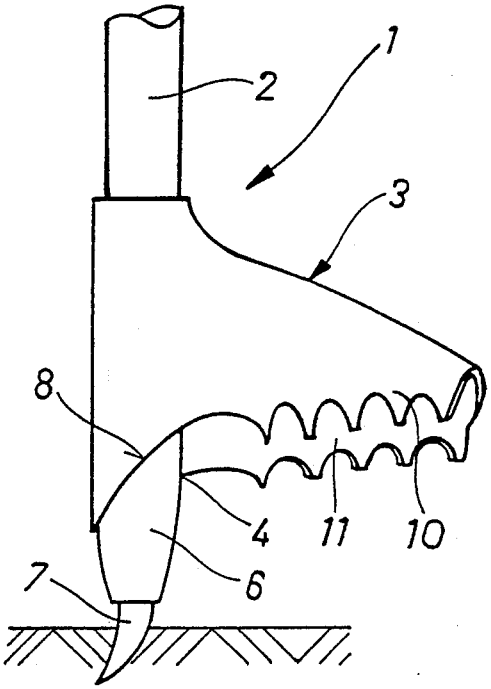
Figure 2:
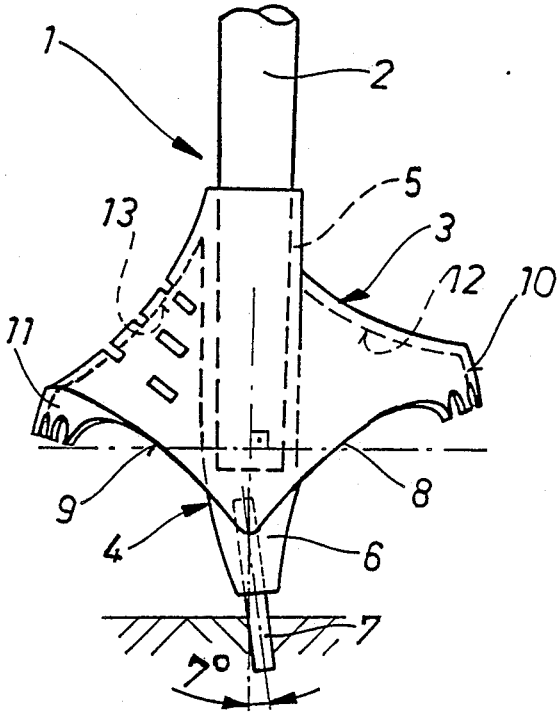
Figure 4:
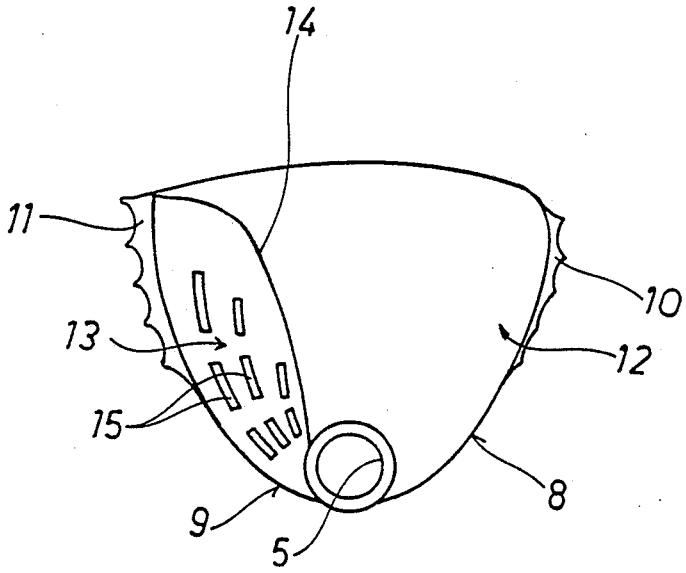

In free technique skiing, the pole is in a sideways inclined position during pushing, the lower end of the pole being farther out. If both side edges of the snow disc are at the same height when the pole stick is in a vertical position, a greater bearing load is exerted on the inner edge of the snow disc. The inner edge of the snow disc sinks deeper into the snow and the significance of the outer edge of the snow disc is minimal. The position of the spike is also not the optimal one as regards gripping. Furthermore, the design of the upper surface of known snow discs is usually such that a snow disc caught under the top end of a ski is difficult to pull up. In free technique skiing such situations do, however, often occur The free technique ski pole relating to the invention is characterized in that, looking from the front, the direction of the longitudinal axis of the pole stick forms an angle of about 5°–15° with respect to the direction of the spike and that the opposite side edges of the snow disc are situated on different levels with respect to each other when the longitudinal axis of the pole stick is in an upright position, but when the pole stick is in a sideways inclined position so that the spike is in an upright position, the side edges of the snow disc are on essentially the same level with respect to the ground An embodiment of the invention is illustrated in greater detail in the following with reference to the accompanying drawings in which FIG. 1 is a front view of the right-hand free technique ski pole relating to the invention and FIG. 2 shows more closely the lower part of the same pole as seen from the front; FIG. 3 shows the same as FIG. 2 but as seen from the inner side on the side of the skier;

FIG. 4 is a top view of the snow disc of the free technique ski pole relating to the invention.

The ski pole as a whole is marked by reference numeral 1. The pole stick 2 is fixed to the snow disc 3 by a sleeve-like fitting 5. The snow disc 3 is made as one piece of relatively rigid plastic which is intended to essentially maintain its shape during use.

The snow disc 3 comprises a sleeve-like part 4, at the top end of which is the said sleeve-like fitting 5 and the lower end of which forms a fastening sleeve 6 for the spike The sleeve-like part 4 can of course be designed in such a way that the sleeve-like fitting 5 and the spike-fastening sleeve 6 are not axial extensions of each other. They are, however, parts of the same piece with the snow disc. The fastening sleeve 6 and the spike 7 fixed to it form in the present case a 7° angle with respect to the longitudinal axis of the pole stick 2 when the pole is looked at from the front in accordance with FIG. 1 or 2. The 7° angle is simply one mean value and this angle may vary within the range of approximately 5°–15°. The sideways inclination also varies between skiers.

The front edge of the claw-like downward curving front part of the snow disc is directly connected with the front edge of the sleeve-like part 4. Since the front part of the snow disc is directed steeply downwards it does not form the bearing surface of the snow disc but sinks into the ground and intensifies the gripping of the snow disc. That half 8 of the edge which is on the side of the spike's 7 inclination direction rises upwards more steeply than the adjacent half 9 of the edge. The inner side edge 10 of the snow disc which is an extension of the more steeply rising front edge half 8 is correspondingly at a higher level than the outer side edge 11 of the snow disc. This difference in height has been chosen in such a way that when the spike 7 is in an upright position, the pole stick 2 being e.g. at a 7° angle with respect to the upright, the side edges 10 and 11 are essentially on the same level Correspondingly, when the longitudinal axis of the pole stick is in a vertical position, the angle between the bearing surface 12 connected to the upper side edge 10 of the snow disc and the horizontal plane is smaller than the angle between the bearing surface 13 connected to the lower side edge 11 of the snow disc and the horizontal plane. The bearing surfaces 12 and 13 meet at the borderline 14 shown in FIG. 3.

From the design of the snow disc 3 and the directioning of the spike 7 as described above follows that in skiing according to the free technique, the spike 7 hits the ground more or less vertically and the snow disc 3 carries essentially more evenly with its entire bearing surface 12, 13. The result of this is that the hold of the pole is more secure and it sinks less into the ground. The load is also distributed more evenly over the snow disc and the disc itself is more durable.

In skiing according to the free technique, it often happens that the skis of the adjacent skier touch the top of the outer edge of the snow disc. To make possible pulling the pole up even in this situation, the bearing surface 13 connected to the outer edge 11 of the snow disc is directed steeply upwards to form an angle of over 40° with the horizontal plane.

The lightening apertures 15 of the snow disc are made only on the outer side bearing surface 13 and thus act also as a visual sign of which hand pole is concerned. This marking can obviously also be done by writing.

What is claimed is:

1. A free technique ski pole stick and a plastic snow disk, a sleeve integral with said snow disk having an opening to receive said pole stick and secure the disk to the stick, said snow disk being asymmetrical in a fore and aft direction about said sleeve with said sleeve being at the forward edge of the disk as the disk and pole would be moved when in use, the lower end of said sleeve extending below the pole stick opening and forming a pin mounting hub, a pin mounted to said hub and projecting downwardly therefrom, said pin at the end of said hub being substantially centered about the central axis of said pole stick, the axis of the portion of the pin projecting beyond the hub being inclined at an angle toward one side of the disk with respect to the axis of the pole stick said one side being that which would be adjacent the user of the pole and the lower edges of said snow disk which extend laterally and rearward from the opposite lateral sides of said sleeve being in a plane laterally inclined to the axis of the pole so that they are substantially normal to the axis of the projecting portion of said pin.

2. The free technique ski pole described in claim 1 wherein said disk is also asymmetrical about a fore and aft plane extending through the axial centerline of said pole stick with the greater portion of said disk being on the side thereof toward which said pin is inclined.

3. The free technique ski pole described in claim 1 wherein the portion of said disk opposite from the direction toward which said pin is inclined being provided with a plurality of apertures therethrough.

4. The free technique ski pole described in claim 1 wherein the inclination of the axis of said pin with respect to the central axis of said pole stick is approximately 7°.

5. The free technique ski pole described in claim 1 wherein the inclination of the axis of said pin with respect to the central axis of said pole stick is in the range of 5° to 15°.

6. The free technique ski pole described in claim 1 wherein the axis of the projecting portion of said pin and the plane of the lower edges of the sides of said disk are both inclined at approximately 7° to the central axis of said pole stick.

7. The free technique ski pole described in claim 1 wherein said hub extends below the plane of the lower edges of the sides of the disk.

8. The free technique ski pole described in claim 1 wherein said pin throughout its entire length is inclined to the axis of the pole stick.

9. A free technique ski pole having a pole stick and a plastic snow disk and a spike projecting below the disk, a sleeve integral with said snow disk having an opening to receive said stick and secure the disk to the stick, said snow disk being asymmetrical about a first plane extending in a fore and aft direction through the centerline of said pole stick, said disk having a hub centered about said first plane, a portion of which hub extends below the disk and at its lower end has a pin receiving opening the open end of which is in said first plane, a pin mounted in said opening in said hub and projecting downwardly therefrom, the axis of the portion of the pin projecting below the hub being laterally inclined at an angle toward the side of the disk adjacent the user of the pole with respect to the axis of the pole stick, the lower edges of said disk laterally of the ski pole being in a plane inclined to the centerline of the pole stick and normal to the pin in the same direction as the axis of the portion of the pin projecting below the hub.

10. A free technique ski pole having a pole stick and a plastic snow disk and a pin projecting below the disk, a sleeve integral with said disk having an opening to receive the stick and secure the disk to the stick, said disk having a hub axially aligned with said sleeve a portion of which hub extends below the disk and at its lower end has an opening, said pin being mounted in said opening in said hub and projecting downwardly therefrom, the axis of that portion of the pin which projects below the hub being inclined at an angle toward one side of the disk with respect to the axis of the pole stick, said one side being that which would be adjacent the user of the pole and the lower edges of the disk being in a laterally inclined plane which plane is substantially normal to the axis of the projecting portion of said pin.

11. A free technique ski pole as described in claim 9 wherein the inclination of said pin's lower portion to the axis of said pole stick is approximately 7°.

* * * * *

UNITED STATES PATENT AND TRADEMARK OFFICE

CERTIFICATE OF CORRECTION

PATENT NO. : 4,955,969

DATED : September 11, 1990

INVENTOR(S) : Rainer Jansson et al.

It is certified that error appears in the above-identified patent and that said Letters Patent is hereby corrected as shown below:

Column 1, line 40:
After "occur" insert -- . --
Column 1, line 51:
After "ground" insert -- . --
Column 2, line 4:
After "spike" insert -- . --
Column 2, line 31:
After "level" insert -- . --
Column 2, line 62:
After "pole" insert -- having a pole --

Signed and Sealed this

Fifth Day of May, 1992

*Attest:*

DOUGLAS B. COMER

*Attesting Officer*

*Acting Commissioner of Patents and Trademarks*